US007322549B2

(12) United States Patent
Luna-Keaton

(10) Patent No.: US 7,322,549 B2
(45) Date of Patent: Jan. 29, 2008

(54) REFUSE CONTAINER RETAINER

(76) Inventor: Melissa M. Luna-Keaton, 7960 Oakville-Waltz Rd., Belleville, MI (US) 48111

( * ) Notice: Subject to any disclaimer, the term of this patent is extended or adjusted under 35 U.S.C. 154(b) by 97 days.

(21) Appl. No.: 11/214,214

(22) Filed: Aug. 29, 2005

(65) Prior Publication Data

US 2007/0045487 A1 Mar. 1, 2007

(51) Int. Cl.
*A47G 23/02* (2006.01)

(52) U.S. Cl. ..... 248/154; 248/156; 248/222.52; 248/508; 248/907

(58) Field of Classification Search ..... 248/154, 248/156, 507, 508, 533, 907, 222.51, 222.52; 49/49, 131; 52/40, 632, 165; 362/153.1, 362/285, 286; 404/6, 9; 403/349
See application file for complete search history.

(56) References Cited

U.S. PATENT DOCUMENTS 2,209,504 A * 7/1940 Beiter ..... 248/530
3,178,142 A * 4/1965 Koch ..... 248/146
4,072,286 A * 2/1978 Foncannon ..... 248/154
4,559,747 A * 12/1985 Engel ..... 52/40
4,919,563 A * 4/1990 Stice ..... 404/6
5,358,209 A * 10/1994 Ward ..... 248/545
5,474,017 A * 12/1995 Mohebbi et al. ..... 116/209
6,036,399 A * 3/2000 Schalk ..... 404/6

* cited by examiner

*Primary Examiner*—Korie Chan
(74) *Attorney, Agent, or Firm*—John L. James

(57) ABSTRACT

A refuse container retainer includes an elongated member, defining an open chamber, that is screwed in to the ground. A collar attached atop the elongated member has a central opening extending the chamber, a base plate adjacent a top portion of the elongated member, and opposed flanges positioned above the base plate. A telescoping upright member seats in the chamber and extends through the collar. The base plate contacts the ground halting embedding of the elongated member and the cover plate conceals it and the upright member to which it is attached. Lifting the cover plate also lifts the upright member to receive a refuse container turned upside down. The refuse container rests on the ground over the cover plate and upright member.

7 Claims, 4 Drawing Sheets

REFUSE CONTAINER RETAINER

TECHNICAL FIELD OF THE INVENTION

This invention relates generally to refuse containers, and, more particularly, to a device for retaining a refuse container to prevent inadvertent displacement into a street or roadway.

BACKGROUND OF THE INVENTION

Household refuse and garbage are temporarily stored in a container, such as a cylindrical metal can, cylindrical plastic container or a parallelepiped plastic container, for disposal at various collection times. Usually, the filled refuse container is placed on or near the curb of the street for collection. While the collection day is fairly certain, the exact collection time is often a mystery. Typically, a person places container out for collection when leaving for work in the morning and retrieves the container when returning from work in the evening often causing the empty container to be exposed several hours after collection. The empty container may be exposed to the elements for several hours where the wind can blow it into the street creating a hazard and possibly damaging the container. Accordingly, it will be appreciated that it would be highly desirable to have a device to restrain the empty container to prevent it from blowing into the street.

Prior efforts to keep refuse containers secure and stationary while unattended after dumping employ an anchored pole with a hook for engaging the handle of the container. While these work, to some extent, to restrain the container, they are dependent upon the effort of the collector to engage the handle of the container with the hook. Unfortunately, a refuse collector cannot always be relied upon to properly hang the container on the hook owing to a lack of time, or initiative, or both. A refuse collector will normally flip the empty container upside down and return it to the area where it was found. Accordingly, it will be appreciated that it would be highly desirable to have a device to restrain a refuse container that requires minimal effort and minimal time.

SUMMARY OF THE INVENTION

The present invention is directed to overcoming one or more of the problems set forth above. Briefly summarized, according to present the invention, an apparatus for retaining a refuse container comprises an elongated member having a top portion, a bottom portion and a middle portion intermediate the top and bottom portions. The top and middle portions define a chamber open at the top portion, and the bottom portion is anchored to the ground. A collar is attached atop the top portion of the elongated member. The collar has a central opening extending the chamber, a base plate adjacent the top portion of the elongated member, and opposed first and second flanges positioned above the base plate. An upright member has one end portion seated in the chamber and extends through the opening of the collar. A cover plate is attached to the free end of the upright member.

A helical cutting edge on the bottom portion of the elongated member facilitates screwing the elongated member into the ground for anchoring. The base plate contacts the ground halting further embedding of the elongated member. The upright member collapses into the chamber where the cover plate conceals it. Lifting the cover plate also lifts the upright member and positions it for receiving a refuse container turned upside down. The refuse container rests on the ground, and the cover plate and upright member prevent inadvertent removal from about the upright member by the wind. Removal of the empty refuse container can only be accomplished by lifting the container a sufficient distance to clear the cover plate.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
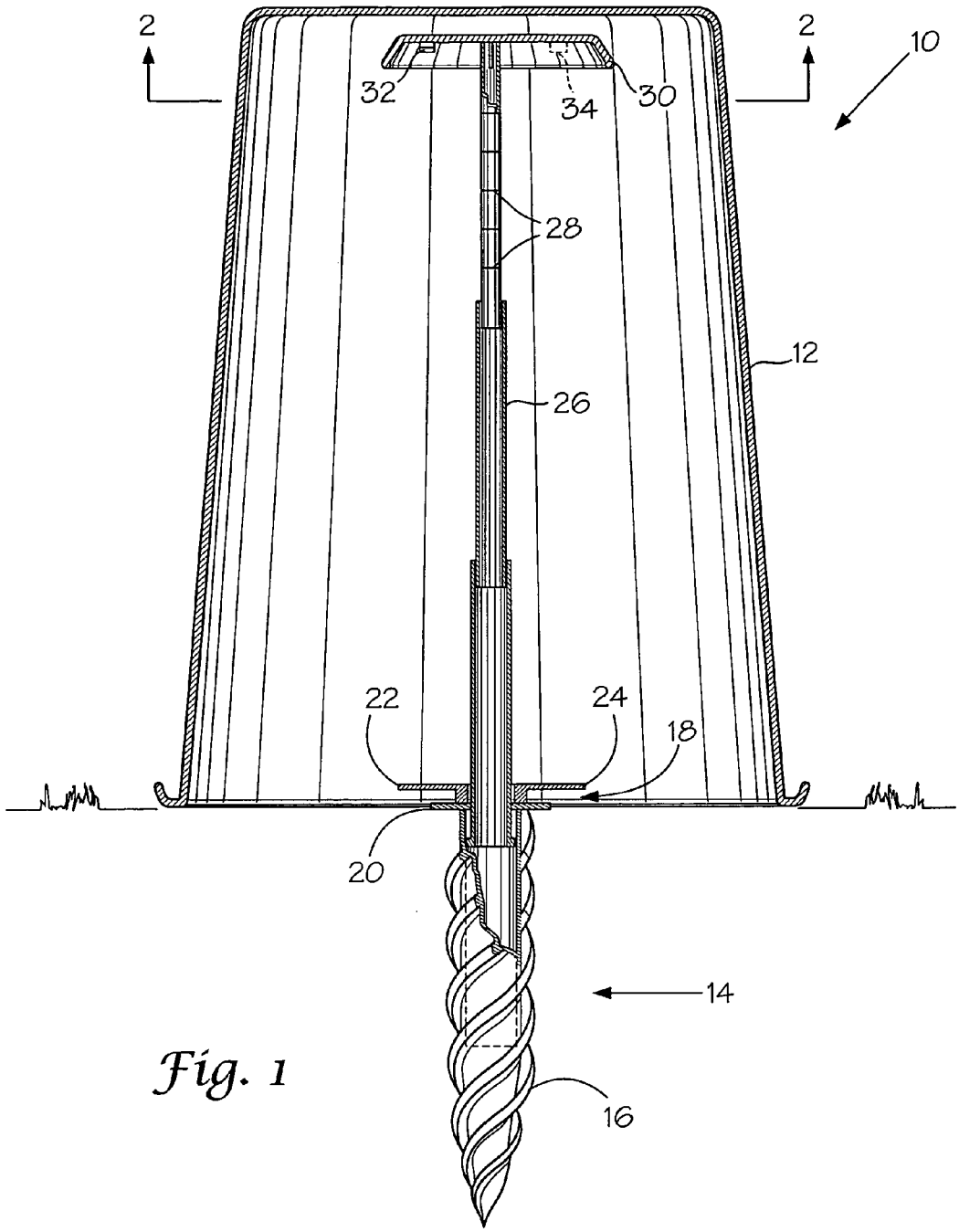
FIG. 1 is a diagrammatic longitudinal sectional view of a preferred embodiment of a refuse container installed on a refuse container retainer according to the present invention.
Figure 2:
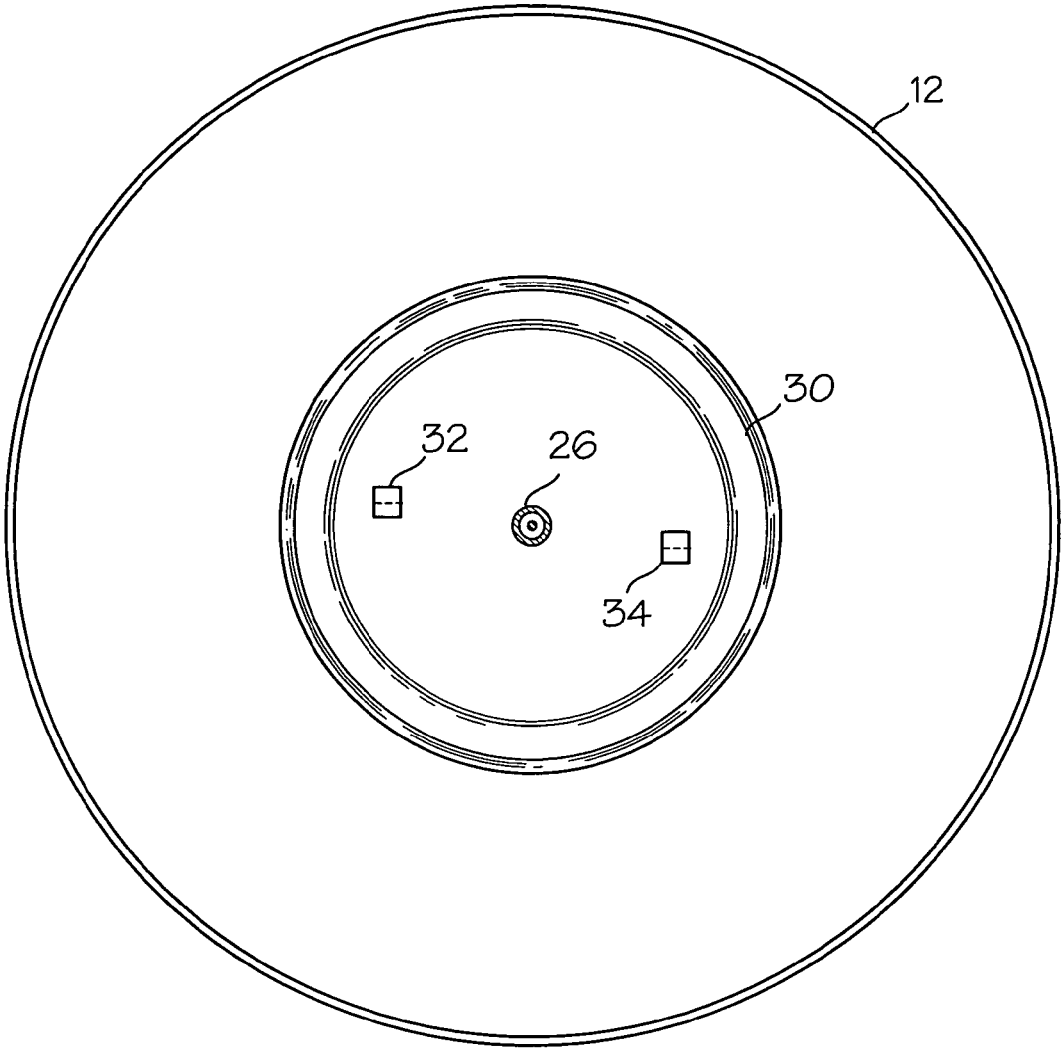
FIG. 2 is a diagrammatic sectional view taken along line 2-2 of FIG. 1.
Figure 3:
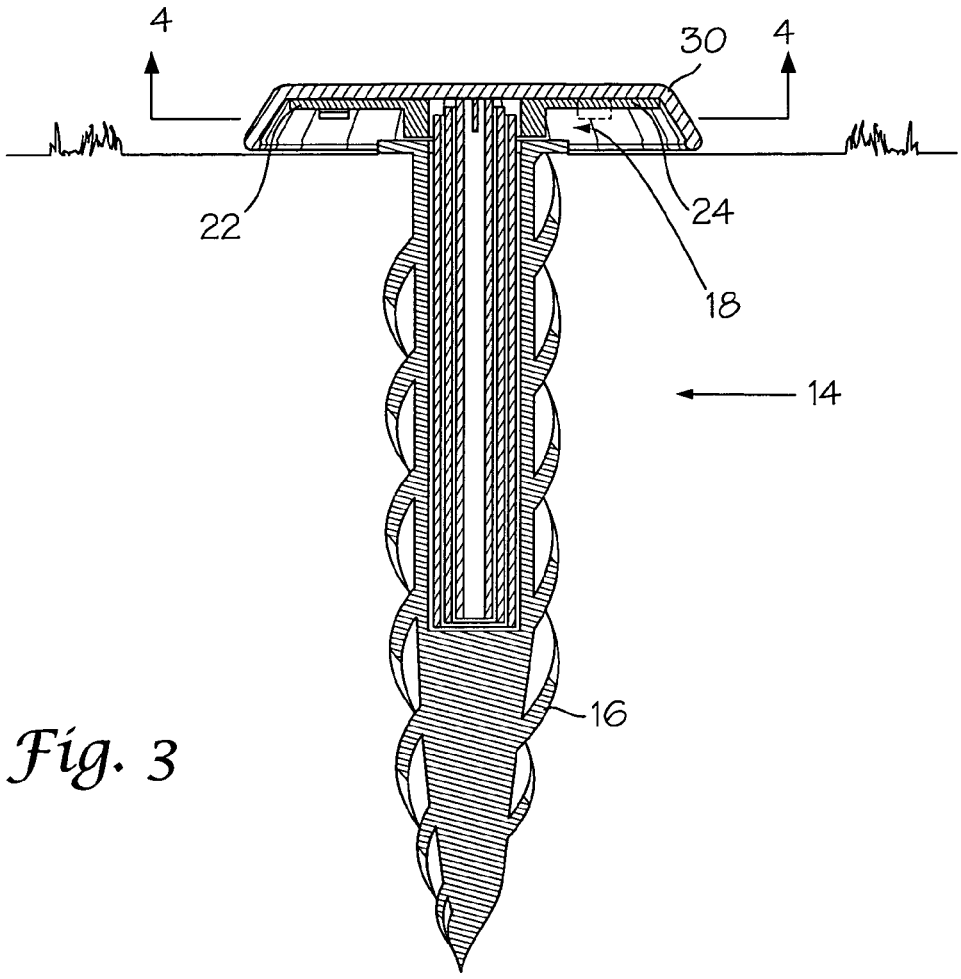
FIG. 3 is diagrammatic longitudinal sectional view of the refuse container retainer of FIG. 1 shown in a stored position.
Figure 4:
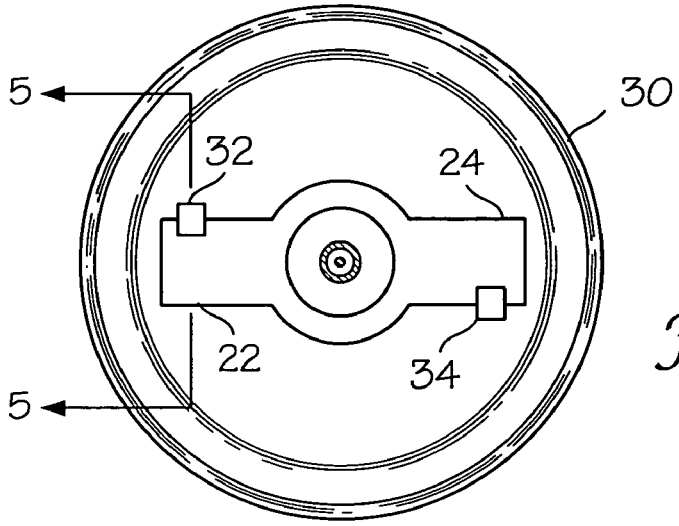
FIG. 4 is a diagrammatic sectional view taken along line 4-4 of FIG. 3.
Figure 5:
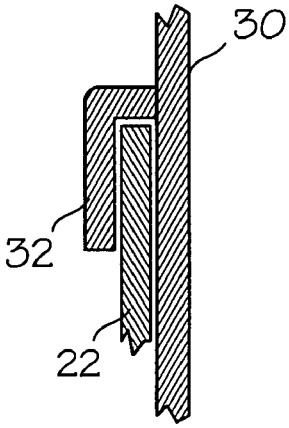
FIG. 5 is a diagrammatic fragmentary sectional view taken along line 5-5 of FIG. 4.
Figure 6:
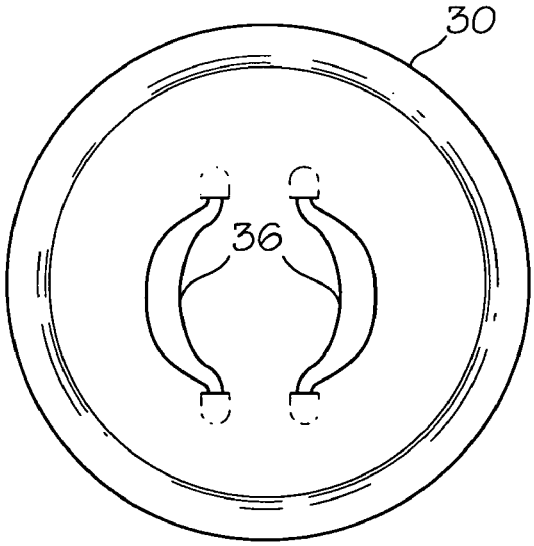
FIG. 6 is a top view of an embodiment of a refuse container retainer with handles.

Referring to FIGS. 1-5, an apparatus 10 is provided for retaining an upside down refuse container 12 at a given locale from inadvertent displacement. The apparatus 10 includes an elongated anchoring member 14 having a top portion, a bottom portion, and a middle portion intermediate the top and bottom portions. The top and middle portions define a chamber open at the top portion.

The bottom portion of member 14 contains means for anchoring the elongated member, such as cutting edge 16. Cutting edge 16 may take the form of a spiral cutting edge on a outer surface of the elongated member 14 adapting the bottom portion to separate and move earth like an auger or screw. Spiral cutting edge may have a single helix, or more preferably, a double helix configuration. To aid earth penetration, the bottom portion of the elongated member 14 preferably has a general conical or pointed configuration. While it is preferred that anchoring member 14 simply screw into the earth and removed as desired, a preformed hole may be used.

A collar 18 attaches on the top portion of elongated member 14. Collar 18 has a central opening extending the chamber upward, a base plate 20 adjacent the top portion of the elongated member 14, and opposed first and second flanges 22, 24 positioned above base plate 20. Preferably, flanges 20, 22 are positioned laterally 180 degrees apart across the central opening to provide adequate leverage to screw member 14 into the earth.

An elongated upright member 26 has one end portion seated in the chamber and extending through the opening of collar 18. Preferably, member 26 has a number of telescoping sections with a distal section having indicia 28 relating to the dimensions of the refuse container 10 so that the proper length is extended to reach toward the upturned bottom of the container without actually touching so that the refuse container rests on the ground about member 26. The telescoping sections nest in the chamber and do not extend beyond collar 18 when nested. Preferably, the telescoping section are infinitely adjustable and lock into position.

A cover plate 30 attaches to the free or distal end of the adjustable upright member 26 with a screw or other fastening device or fastening means. Upright member 26 extends and lifts cover plate 30 away from collar 18, and retracts pulling cover plate 30 to collar 18. Cover plate 30 has a diametrical dimension larger than the lateral dimension of flanges 22, 24. When retracted cover plate 30 completely covers flanges 22, 24.

A pair of L-shaped brackets 32, 34 extend from a bottom surface of cover 30 toward collar 18 forming a catch for engaging the flanges 22, 24 to lock cover 30 to collar 18 and to anchor member 14. A top surface of cover 30 preferably has a handhold or handle 36 for lifting cover 30 and telescoping upright member 26.

It can now be appreciated that an apparatus has been presented for retaining an empty, upside down refuse container in a given locale thereby preventing the container from blowing into the street. The apparatus comprises an elongated member that has top portion, bottom and middle portions. The top and middle portions define a chamber open at the top portion. An auger on the bottom portion anchors the elongated member to the ground. A collar attached atop the top portion of the elongated member has a central opening extending the chamber. The collar has a base plate adjacent the top portion of the elongated member and opposed flanges positioned above the base plate. A telescoping member is seated in the chamber and extends through the opening of the collar. A cover plate is attached to the free end of the adjustable upright member. The apparatus requires minimal effort and minimal time to install. It retains an empty container to prevent the container from blowing into the street. When installed on an entire street, the street remains neat and orderly on collection day.

While the invention has been described with particular reference to the preferred embodiments, it will be understood by those skilled in the art that various changes may be made and equivalents may be substituted for elements of the preferred embodiments without departing from invention. For example, the handle may be omitted and the fingers used along the edges of the cover to lift it. Also, the telescoping member may be removed while leaving the auger embedded in the earth.

As is evident from the foregoing description, certain aspects of the invention are not limited to the particular details of the examples illustrated, and it is therefore contemplated that other modifications and applications will occur to those skilled in the art. For example, while plastic may be used for the cutting edge, where the earth is particularly dense or rocky, metal is more durable. Also, the cover plate may be colored or painted blue, orange or other color alerting sanitation and other workers of the presence of the apparatus. It is accordingly intended that the claims shall cover all such modifications and applications as do not depart from the true spirit and scope of the invention.

ELEMENT LIST

10 retaining apparatus
12 refuse container
14 elongated anchoring member
16 cutting edge
18 collar
20 base plate
22, 24 flanges
26 upright telescoping member
28 indicia
30 cover plate
32, 34 L-shaped brackets

What is claimed is:

1. An apparatus for retaining an upturned refuse container when positioned over said apparatus to prevent inadvertent displacement from a given location, said refuse container having a bottom and a sidewall, said apparatus, comprising:

an elongated member having a top portion, a bottom portion and a middle portion intermediate said top and bottom portions, said top and middle portions defining a chamber open at said top portion;

means on said bottom portion for anchoring said elongated member at said given location;

a collar attached atop said top portion of said elongated member, said collar having a central opening extending said chamber, said collar having a base plate adjacent said top portion of said elongated member and having opposed first and second flanges positioned above said base plate, said flanges having a lateral dimension;

an upright member having telescoping sections with one end portion of one section seated in said chamber and extending through said opening of said collar and having another section with a free end extendable upward from said collar toward the bottom of the refuse container;

a cover plate having a diametrical dimension larger than said lateral dimension of said flanges, said cover plate being attached to said free end of said adjustable upright member and movable therewith as said free end extends so that said cover plate is disposed inside said container free of contact with said bottom and sidewall, said cover plate contacting said sidewall to prevent the refuse container from inadvertently moving from the given location; and a handle attached to said cover plate.

2. An apparatus, as set forth in claim 1, wherein said means comprises a spiral cutting edge on a outer surface of said elongated member adapting said bottom portion of said elongated member to separate and move earth.

3. An apparatus, as set forth in claim 1, wherein said means comprises a helical cutting edge on a outer surface of said elongated member.

4. An apparatus, as set forth in claim 1, wherein said means comprises a double helical cutting edge on a outer surface of said elongated member.

5. An apparatus, as set forth in claim 1, wherein said bottom portion of said elongated member has a general conical configuration.

6. An apparatus, as set forth in claim 1, wherein said cover plate has a catch for engaging said flanges.

7. An apparatus, as set forth in claim 6, wherein said cover plate has a bottom surface facing said collar and wherein said catch comprises first and second L-shaped brackets extending from said bottom surface adapted to engage sides of said flanges.

* * * * *